United States Patent [19]

Rantala et al.

[11] Patent Number: 4,966,653

[45] Date of Patent: Oct. 30, 1990

[54] APPARATUS FOR CONTROLLING A MOVING BAND

[75] Inventors: Mauri Rantala, Nokia; Lasse Syrjä, Tampere, both of Finland

[73] Assignee: Oy Tampella AB, Tampere, Finland

[21] Appl. No.: 412,933

[22] Filed: Sep. 26, 1989

[30] Foreign Application Priority Data

Oct. 26, 1988 [FI] Finland ..... 884943

[51] Int. Cl.[5] ..... D21F 1/40

[52] U.S. Cl. ..... 162/273; 162/257; 474/104

[58] Field of Search ..... 162/272, 273, 274, 199, 162/200, 257; 474/104, 117, 135; 198/807; 226/21

[56] References Cited

U.S. PATENT DOCUMENTS

| | | | |
|---|---|---|---|
| 1,205,661 | 11/1916 | Plansoen | 198/807 |
| 3,009,364 | 11/1961 | Beachler | 474/104 |
| 3,043,153 | 7/1962 | Hindle et al. | 474/104 |
| 3,101,005 | 8/1963 | Mittag | 474/104 |
| 3,452,908 | 7/1969 | Hindle et al. | 474/104 |
| 4,645,066 | 2/1987 | Richardson | 198/807 |

FOREIGN PATENT DOCUMENTS

| | | | |
|---|---|---|---|
| 525929 | 11/1976 | U.S.S.R. | 162/257 |

*Primary Examiner*—Karen M. Hastings
*Attorney, Agent, or Firm*—Ladas & Parry

[57] ABSTRACT

The invention relates to an apparatus for controlling the passage of a moving band (1) or the like in a paper machine or the like. The apparatus comprises a roll (2) mounted at one end turnably with respect to a machine body (3) while the other end is mounted turnably to an adjusting device (6). The adjusting device comprises a turning arm (9) for a roll (2) and an auxiliary arm (10) which are mounted coaxially turnably. The apparatus further comprises one or more air bellows (13) connected between the turning arm (9) and the auxiliary arm (10). Furthermore, at least one liquid bellows (11) is provided between the auxiliary arm (10) and the body or a body part (7). The position of the auxiliary arm (10) with respect to the body is adjusted by varying the amount of liquid in the liquid bellows. By varying the volume of the bellows, the roll (2) is turned about a shaft (8) and the direction of the roll shaft with respect to the longitudinal direction of the band (1) in its transverse direction. (FIG. 2).

7 Claims, 1 Drawing Sheet

FIG. 1
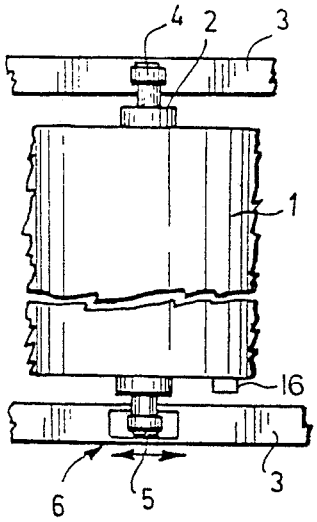
FIG. 2
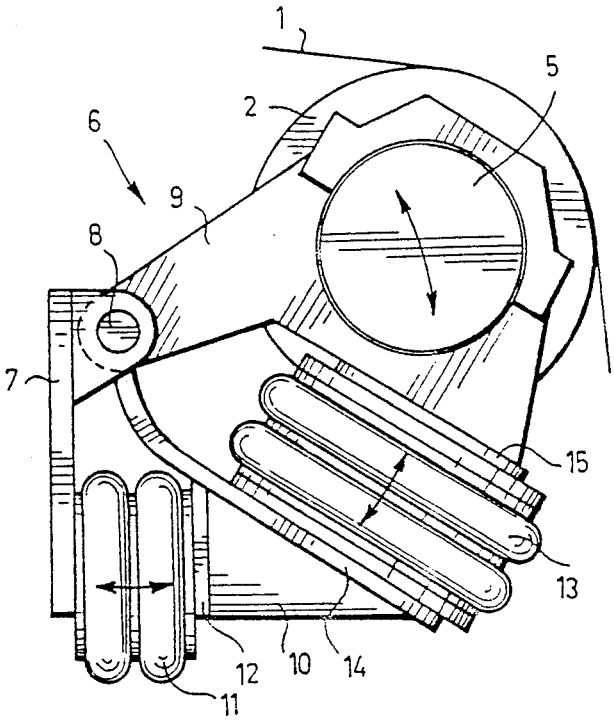
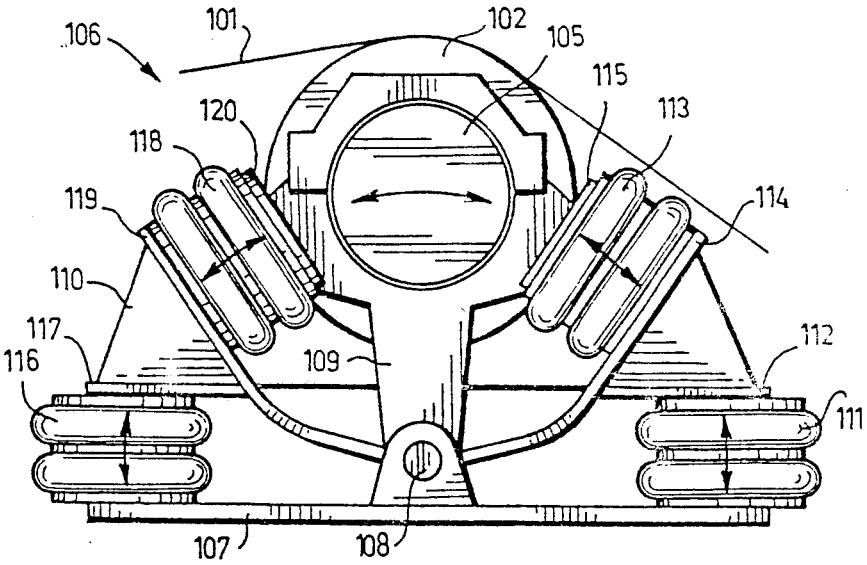
FIG. 3

APPARATUS FOR CONTROLLING A MOVING BAND

The invention relates to an apparatus for controlling the passage of a moving band, comprising a control roll making contact with the band and extending transversely of the band, an adjusting device comprising a turning arm mounted turnably with respect to a machine body about a turning shaft transverse to the band, and at least two adjusting devices acting between the turning arm and the machine body, the position of the turning arm with respect to the machine body being adjustable by means of the adjusting devices, whereby one end of the control roll is mounted turnably to the machine body while the other end is mounted to the turning arm at a distance from the turning shaft, the position of the shaft of the control roll relative to the longitudinal direction of the band being adjustable by varying the position of the turning arm.

Such apparatuses are used in paper machines so as to control the passage of wires, felts or a formed web in order to keep them properly oriented in the sideward direction with respect to the machine. As used in this application, the term "paper machine" refers to a paper machine, paper board machine or the like machine producing a fibrous web. The apparatuses comprise a roll transverse to the band to be controlled. The roll can be slanted in some direction with respect to the longitudinal direction of the band, so that it tends to displace the band in the direction of its width when its shaft is at an oblique angle with respect to the direction of movement of the band.

For the adjustment of the position of the roll, the roll is mounted in ball bearings at its both ends so that it is able to turn with respect to the body of the machine. One of the bearings is usually mounted fixedly in the body so that the roll turns relative to the bearing point only whereas the position of the shaft does not change when the roll turns. The other end of the roll is usually provided with two adjusting devices, by means of which the position of that end of the roll with respect to the body and, as a consequence, with respect to the longitudinal direction of the band, can be altered either from beside the roll or by means of an element sensing the edge of the band or from the control room of the machine.

SE Patent No. 214 532 (U.S. Pat. No. 3,043,153) discloses a similar apparatus, in which the adjusting means comprise a suspension arm to which the roll is mounted in bearings at its one end and which is suspended turnably on a shaft positioned above the roll in such a manner that the end of the roll can be displaced along an arched path in the longitudinal direction of the band. For the adjustment of the position of the roll, the roll comprises a manually operable adjusting screw connected to the suspension arm as well as to the machine body by means of a flange so that when the screw is turned, it remains stationary with respect to the body, displacing the suspension arm in the horizontal direction while turning the roll. For remote control, the apparatus further comprises a pneumatic cylinder connected to the machine body and to the suspension arm. To turn the roll pressurized air is introduced into the pneumatic cylinder to either side, whereby the piston of the cylinder turns the suspension arm while it moves, thus displacing the end of the roll. In order that the adjusting screw would not prevent the adjustment to be carried out by means of the pneumatic cylinder, it is secured to the body by means of flanges supported by springs and allowing the displacement of the screw longitudinally of the body.

A drawback of this solution is that the mechanical control construction contains several moving parts, requiring regular maintenance. Moreover, the adjusting means have to be positioned according to the requirements of the geometry and position of the roll, whereby the manual adjustment may be difficult if not impossible. Furthermore, the manual adjustment is inoperative while pneumatic adjustment is used, because the pneumatic adjustment fully eliminates the effect of the manual adjustment.

The object of the present invention is to provide a simple apparatus reliable in operation by means of which the adjustment can be carried out simply and easily and the mechanical components of which require only little maintenance. This is achieved according to the invention in such a manner that the adjusting device comprises an auxiliary arm mounted so as to turn coaxially with the turning arm, that at least one of the adjusting devices is mounted between the body and the auxiliary arm in such a manner that the position of the auxiliary arm with respect to the body is adjustable by means of the adjusting device, that at least one of the adjusting devices is mounted between the auxiliary arm and the turning arm in such a manner that the position of the turning arm with respect to the auxiliary arm is adjustable by means of the adjusting device, whereby the position of the turning arm with respect to the body and as a consequence the position of the control roll is adjustable with respect to the band by means of one or more adjusting devices.

The basic idea of the invention is that the adjustment is carried out by means of the auxiliary arm turning coaxially with the turning arm of the roll, one adjusting device being connected between the machine body and the auxiliary arm and another adjusting device between the auxiliary arm and the turning arm of the roll, whereby the adjustment carried out by means of one adjusting device does not affect the operation of the other adjusting device, but both of them can be operated independently of each other.

An advantage of the invention is that it is applicable to the adjustment of both vertical and horizontal rolls. Furthermore, it is possible to position the control roll by means of one adjusting device in such a manner that the range of adjustment of the other adjusting device controlled by the sensing element sensing the edge of the band is as large as possible on both sides of the desired position of the roll. In a preferred embodiment of the invention, in which the adjustment is carried out by means of a substantially inflexible liquid bellows positioned between the body and the auxiliary arm and a flexible air bellows positioned between the turning arm and the auxiliary arm, a further advantage is obtained in that the manual adjusting devices, that is, the liquid bellows, can be positioned suitably according to the requirements of the adjustment and ease of use. Thereby the adjustment can be carried out, e.g., from the control room of the machine using means sensing the adjusting position.

Brief Description of the Drawings

The invention will be described in more detail in the attached drawings, wherein FIG. 1 is a general view of an apparatus of the invention when installed in a machine;

FIG. 2 shows an embodiment of the apparatus of the invention; and

FIG. 3 shows another embodiment of the apparatus of the invention.

FIG. 1 shows generally an apparatus installed in a paper machine or the like. It comprises a roll 2 mounted transversely to the direction of movement of the web 1. One end of the roll 2 is mounted immovably but turnably to a machine body 3 by means of a bearing 4 while the other end is mounted movably and turnably with respect to the machine body 3 by means of a bearing 5. The bearing 5 is connected to the machine body 3 by means of an adjusting device 6.

FIG. 2, which is an end view of one embodiment of the apparatus of the invention, shows a fibre web 1 in a side view. The web passes over a roll 2. The bearing 5 of the roll 2 is connected to the adjusting device 6. Both the bearing 4 and the bearing 5 are so called ball bearings which can turn about a spherical surface so that the bearing of the roll shaft is always in the right position relative to the roll shaft.

The device 6 comprises a body part 7 attached to the body 3 (not shown). A turning arm 9 for the roll 2 is mounted in the body part 7 turnably about a shaft 8 and an auxiliary arm 10 is mounted turnably about the same shaft 8. A liquid bellows 11 is mounted between the body part 7 and the auxiliary arm 10. The bellows 11 is secured to the body part 7 as well as to a flange 12 provided in the auxiliary arm 10. The device further comprises an air bellows 13 positioned between the auxiliary arm 10 and the turning arm 9. The air bellows 13 is secured to a flange 14 in the auxiliary arm and to a flange 15 in the turning arm.

When using the apparatus, the position of the auxiliary arm 10 with respect to the body part 7 is adjusted first by means of the liquid bellows 11 either by introducing liquid thereinto or by removing liquid therefrom. This is a kind of basic adjustment. The air bellows 13, in turn, is connected to an element 16 sensing the position of the edge of the band 11. Such a sensing element is known per se and will therefore not be described. Depending on the position of the edge of the web, the sensing element causes more or less air to be introduced into the air bellows, whereby the position of the roll 2 and, as a consequence, the direction of its shaft with respect to the longitudinal direction of the band 1 changes correspondingly. The arrows drawn in the bellows 11 and 13 and in the bearing 5 illustrate the influence of the filling or emptying of the bellows on the position of the roll 2.

The liquid bellows 11 can be operated, e.g., by remote control from the control room of the machine, whereby the apparatus should be provided with a sensor for sensing the position of the auxiliary arm 10. The sensor indicates either the turning angle of the auxiliary arm 10 or the thickness of the bellows 11. Such instrumentation and measuring techniques are generally known per se and will not be described more closely herein.

FIG. 3 shows another embodiment of the apparatus of the invention as seen from the end of the roll. The figure shows a band 101 which passes over the roll 102. The roll 102 is connected to an adjusting device 106 by means of a ball bearing 105. The adjusting device comprises a body part 107 attached to a machine body not shown and a supporting lever 109 mounted turnably with respect to the body part about a shaft 108 substantially parallel to the axis of the roll 102. The bearing 105 is attached to the supporting lever 109 in a manner known per se and will not be described in greater detail herein. Furthermore, an auxiliary arm 110 comprising arms projecting on both sides of the roll 102 is mounted in the apparatus so as to turn about the shaft 108. A liquid bellows 111 is mounted between one arm of the auxiliary arm 110 and the body part 107. The liquid bellows 111 is secured to the body part 107 as well as to a flange 112 in the auxiliary arm 110. An air bellows 113 is mounted on the same side of the roll between the respective arm of the auxiliary arm 110 and the turning arm 109. The air bellows 113 is secured to a flange 114 in the auxiliary arm and to a flange 115 in the turning arm. On the other side of the roll 102 there is provided an air bellows 116 between the body part 107 and the other arm of the auxiliary arm 110. The air bellows 116 is secured to the body part 107 and correspondingly to a flange 117 in the auxiliary arm 110. A third air bellows 118 is provided between the auxiliary arm 110 and the turning arm 109. This air bellows 118 is secured to a flange 119 in the auxiliary arm 110 and to a flange 120 in the turning arm 109. In this structure, the adjustmet is based on a state of equilibrium between the bellows, whereby the basic adjustment is carried out by means of the liquid bellows 111 and the adjustment to be carried out with respect to the edge of the band 101 is effected by means of the air bellows 113 and 118. The second air bellows 116, forming a pair of adjusting bellows with the liquid bellows 111, is arranged to push the auxiliary arm 110 towards the liquid bellows 111. The adjusting pressure of the liquid bellows 111 exceeds that of the air bellows 116, whereby the position of the auxiliary arm 110 can be adjusted simply by filling or emptying the liquid bellows 111, and the second air bellows 116 either yields or correspondingly pushes the auxiliary arm 110 towards the liquid bellows 111 so as to obtain a state of equilibrium. Correspondingly, the pressure of the air bellows 113 is adjusted in response to a sensing element 16 sensing the edge of the band 101, whereby an increase in pressure causes the roll 102 to be turned on the auxiliary arm 110 in the figure to the left while a decrease in pressure causes it to turn to the right. Such an adjustment based on pairs of bellows, shown in FIG. 3, is necessary because otherwise the weight of the roll would tend to exert a tractive force on the bellows 113 and 111 when the supporting lever 109 and the auxiliary arm 110 are turned to the left in the figure, which would make the adjustment unreliable and unstable. In order to prevent this, the bellows 116, 118 are used which all the time cause the roll 102 to be pushed to the right in the figure, thus creating a state of equilibrium.

The above description and the figures deal with certain embodiments of the invention only and the invention is not in any way restricted thereto. In place of a body part 7, the adjusting device can be fixed directly to lugs fastened to the machine body so that it turns about the shaft 8 or 108, respectively. The shape of the auxiliary arm and the position of the bellows can be different and they can be positioned in different order with respect to the roll. When using adjustment based on pairs of bellows, it is possible to use two liquid bellows, for instance, in place of a liquid bellows and an air bellows, whereby the two liquid bellows can be adjusted simultaneously or one of them can be connected to a separate pressure accumulator which allows the liquid to flow away from the bellows and back thereinto while keeping the pressure substantially constant. Alternately, an air bellows can be positioned between the auxiliary arm and the body and a liquid bellows can be positioned between the auxiliary arm and the turning arm.

We claim:

1. An apparatus for controlling the passage of a moving band (1; 101), comprising a control roll (2; 102) having a shaft making contact with the band (1; 101) and extending transversely of the band (1; 101), an adjusting means (6; 106) comprising a turning arm (9; 109) mounted turnably with respect to a machine body (3) about a turning shaft (8; 108) transverse to the band (1; 101), and at least two bellows type adjusting devices (11, 13; 111, 113, 116, 118) acting between the turning arm (9; 109) and the machine body (3), the position of the turning arm (9; 109) with respect to the machine body (3) being adjustable by means of the bellows type adjusting devices, whereby one end of the control roll (2, 102) is mounted turnably to the machine body (3) while the other end is mounted to the turning arm (9; 109) at a distance from the turning shaft (8; 108), the position of the shaft of the control roll (2; 102) relative to the longitudinal direction of the band (1; 101) being adjustable by varying the position of the turning arm (9; 109), characterized in that the adjusting means (6; 106) comprises an auxiliary arm (10, 110) mounted so as to turn coaxially with the turning arm (9; 109), that at least one of the at least two bellows type adjusting devices (11; 111, 116) is mounted between the body (3) and the auxiliary arm (10; 110) in such a manner that the position of the auxiliary arm (10; 110) with respect to the body (3) is adjustable by means of said at least one of the at least two bellows type adjusting devices (11; 111, 116), that at least another of the at least two bellows type adjusting devices (13; 113, 118) is mounted between the auxiliary arm (10; 110) and the turning arm (9; 109) in such a manner that the position of the turning arm (9; 109) with respect to the auxiliary arm (10; 110) is adjustable by means of said at least another of the at least two bellows type adjusting devices (13; 113, 118), the adjusting means being structured and arranged so that the position of the turning arm (9; 109) with respect to the body (3) and as a consequence the position of the control roll (2; 101) is adjustable with respect to the band (1; 101).

2. An apparatus according to claim 1, characterized that the auxiliary arm (10; 110) is mounted between the body (3) and the turning arm (9; 109), and the at least two bellows type adjusting devices (11, 13; 111, 113; 116, 118) between the body (3) and the auxiliary arm (10; 110) and between the auxiliary arm (10; 110) and the turning arm (9; 109) are positioned in series with each other.

3. An apparatus according to claim 2, characterized in that the at least one of the at least two bellows type adjusting devices between the auxiliary arm (10; 110) and the body (3) is a liquid bellows (11; 111) and that the at least another of the at least two bellows type adjusting devices between the auxiliary arm (10; 110) and the turning arm (9; 109) is an air bellows (13; 113).

4. An apparatus according to claim 2, characterized in that the at least one of the at least two bellows type adjusting devices between the auxiliary arm (10; 110) and the body (3) is an air bellows and that the at least another of the at least two bellows type adjusting devices between the auxiliary arm (10; 110) and the turning arm (9; 109) is a liquid bellows.

5. An apparatus according to claim 1 characterized in that the turning arm (109) is mounted vertically, that the auxiliary arm (110) projects on both sides of the turning shaft (108) between the both (3) and the turning arm (109), and the at least two bellows type adjusting devices are provided on both sides of the turning arm (109) between it and the auxiliary arm (110) and between the auxiliary arm (110) and the body (3), respectively.

6. An apparatus according to claim 5, characterized in that the at least two bellows type adjusting devices between the between the turning arm (109) and the auxiliary arm (110) are air bellows (113, 118) and that one of the at least two bellows type adjusting devices between the auxiliary arm (110) and the body (3), on one side of the turning arm (109), is a liquid bellows (111) and another of the at least two bellows type adjusting devices between the auxiliary arm and the body, on another side of the turning arm, is an air bellows (116).

7. An apparatus according to claim 3 characterized in that the liquid bellows (11; 111) is arranged to be adjusted in a remote controlled manner and the air bellows between the turning arm (8; 109) and the auxiliary arm (10; 110) is arranged to be controlled by means of an element sensing the position of the edge of the band (1; 101).

* * * * *